United States Patent [19]

Clayton

[11] 4,332,347

[45] Jun. 1, 1982

[54] PLASTIC BAG HAVING UNIQUE TUCK FLAP CONSTRUCTION

[75] Inventor: William J. Clayton, Fairport, N.Y.

[73] Assignee: Mobil Oil Corporation, New York, N.Y.

[21] Appl. No.: 216,352

[22] Filed: Dec. 15, 1980

[51] Int. Cl.[3] ..... B65D 33/24

[52] U.S. Cl. ..... 229/62; 229/56

[58] Field of Search ..... 229/62, 56; 150/7

[56] References Cited

U.S. PATENT DOCUMENTS

| | | | |
|---|---|---|---|
| 2,620,842 | 12/1952 | Hoeppner et al. | 150/7 |
| 2,737,136 | 3/1956 | Ryder | 229/62 |
| 3,017,070 | 1/1962 | London | 229/62 |
| 3,155,134 | 11/1964 | Buono | 150/7 |
| 3,960,314 | 6/1976 | Faiers | 150/7 |
| 3,985,290 | 10/1976 | Smirt | 229/54 R |

FOREIGN PATENT DOCUMENTS

| | | | |
|---|---|---|---|
| 1334831 | 10/1973 | United Kingdom | 229/62 |

*Primary Examiner*—Stephen P. Garbe

*Attorney, Agent, or Firm*—Charles A. Huggett; Michael G. Gilman; James F. Powers, Jr.

[57] ABSTRACT

Disclosed is a plastic bag, particularly suitable for sandwiches, comprising front and back side walls interconnected to one another at their side and bottom edges and defining between them a top opening which is closable by a fold-over cuff provided adjacent the top opening at the front of the bag. A tuck-in cuff is formed along a portion of the back wall and has a bottom opening permitting insertion of the user's fingers therein to facilitate the tucking in of the tuck-in cuff over an object in the bag prior to folding over the fold-over cuff to close the bag opening.

4 Claims, 9 Drawing Figures

PLASTIC BAG HAVING UNIQUE TUCK FLAP CONSTRUCTION

BACKGROUND OF THE INVENTION

The present invention relates to plastic bags and in particular to plastic bags of the so-called "fold-lock" top construction in which a cuff provided at the front side of a bag adjacent an opening can be folded over by a user to close the opening. Generally, this type of bag has a tuck-in flap provided on a back wall which is tucked in over an object placed within the bag prior to closing the top opening with the fold-over cuff. The tuck-in flap is constructed of a single layer of plastic and is often wrinkled as it emerges from a box or other container housing a plurality of such bags. The single layer flap is difficult to neatly tuck-in over an object not only because of its initially wrinkled state, but also because of its tendency to easily wrinkle making it difficult for a user to smooth this flap out over an object. If the object stored is food and the tuck-in flap is not neatly tucked in, it may adversely affect the object's freshness.

The present invention is designed as a considerable improvement over the single layer tuck-in flap conventionally employed. It provides a tuck-in cuff on the back side of the bag which enables a user to insert his fingers into the cuff to assist in neatly tucking the cuff over an object. The tuck-in cuff is formed of at least two layers of a plastic material and thus does not easily wrinkle in storage or handling. It also maintains a neater appearance and because it can be easily smoothed out it better retains the freshness of a food product. The tuck-in cuff can also be easily manufactured with only minor modifications to machinery normally employed in manufacturing the so-called "fold-lock" bag.

Accordingly, a principal object of this invention is to provide a "fold-lock" bag construction which has a unique tuck-in cuff to facilitate the tucking in operation thus providing a neater appearance and improved freshness for a product inserted into the bag. An additional object of the invention is to provide a tuck-in cuff which is of simple construction and which can readily be produced with only minor modifications to conventional machinery.

These and other objects and advantages of the invention will be readily seen in the ensuing description of the invention which is provided with conjunction with the accompanying drawings.

DETAILED DESCRIPTION OF THE INVENTION

Figure 1:
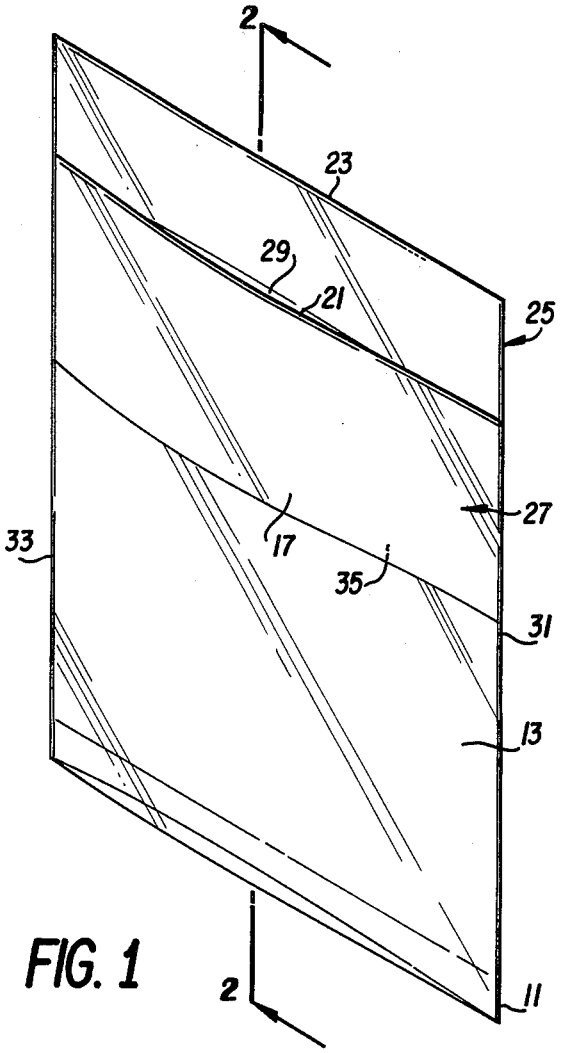
FIG. 1 is a perspective view of a plastic bag constructed in accordance with the teachings of the invention.
Figure 2:
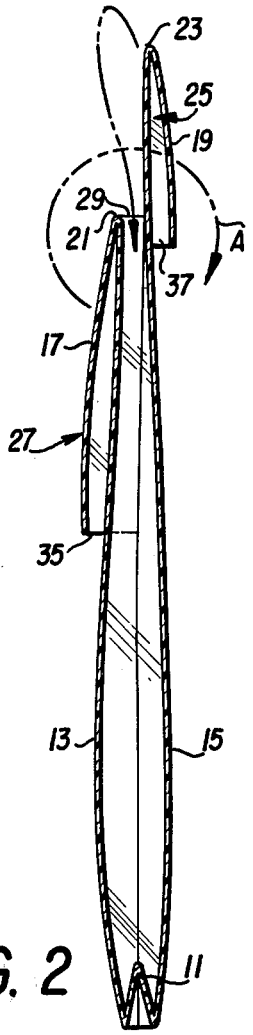
FIG. 2 is a sectional view taken along the lines 2—2 of FIG. 1.

FIGS. 1 and 2 illustrate a bag constructed in accordance with the teachings of the present invention. The bag illustrated in a sandwich bag, although it should be clear that this size of bag is purely exemplary, as other sizes can also be used. As illustrated in FIGS. 1 and 2, the bag includes a front wall 13 and back wall 15 which are interconnected at their side edges 31 and 33 and at their bottoms by a W-shaped bottom portion 11. The front wall 13 and back wall 15 together define a top opening 29 between them for insertion of objects into the bag. A fold-over cuff 27 is provided adjacent the top edge 21 of the front wall 13 and is conveniently formed by folding over a portion of the front wall 13 and attaching the folded over portion along its side edges to the side edges 31 and 33 of the front and back walls 13 and 15. The portion of the front wall 13 which is folded over is illustrated as a first cuff wall 17. The fold-over cuff 27 has a bottom opening 35. As is well known, the fold-over cuff 27 can be folded over, as illustrated by arrow A in FIG. 2, to close the top opening 29 of the bag.

A tuck-in cuff 25 is also provided on a back side of the bag as an extension of back wall 15. The tuck-in cuff 25 may be conveniently formed by extending an upper portion of the back wall 15 and folding it over at top edge 23 to provide a second cuff wall 19 opposite to an upper portion of the back wall 15. The second cuff wall 19 is attached at its side edges to edges 31 and 33 of the bag (FIG. 5) and defines together with back wall 15 a cuff having a bottom opening 37. Both the fold-over cuff 27 and tuck-in cuff 25 are thus similarly constructed.

Figure 3:
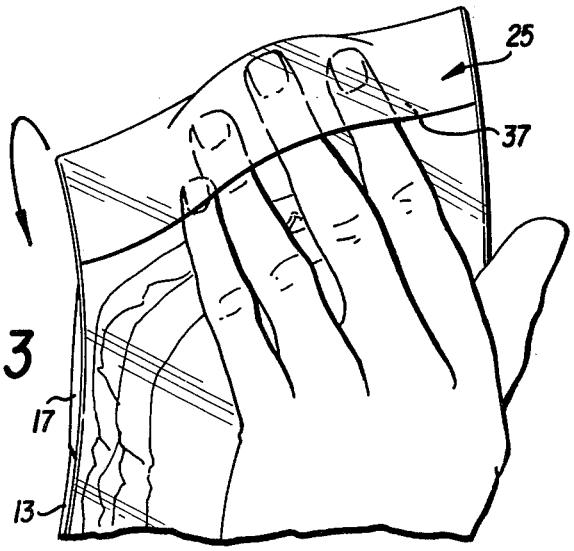
FIG. 3 is a perspective view of the back side of the sandwich bag of FIG. 1 showing manipulation of the tuck-in cuff by a user during a tuck-in operation.
Figure 4:
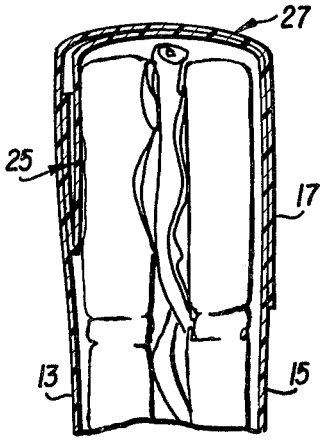
FIG. 4 is a sectional view illustration of the bag of FIG. 1 after the tuck-in cuff has been tucked in and the fold-over cuff is folded over to close the bag opening.

Use of the illustrated bag will now be described. FIG. 3 illustrates the beginning of a tuck-in operation as a user inserts his fingers into the tuck-in cuff 25 and folds the tuck-in cuff over an object placed in the bag. The tuck-in cuff enables the user to slide his fingers therealong to neatly tuck the cuff in place. Thereafter, the fold-over cuff 27 is pulled up and over the top opening 29 of the bag over the tuck-in cuff to finish the bag closing operation. FIG. 4 illustrates in side sectional view the bag of the invention after the tuck-in cuff 25 has properly been tucked in and the fold-over cuff 27 properly folded over to close the bag opening.

Figure 5:
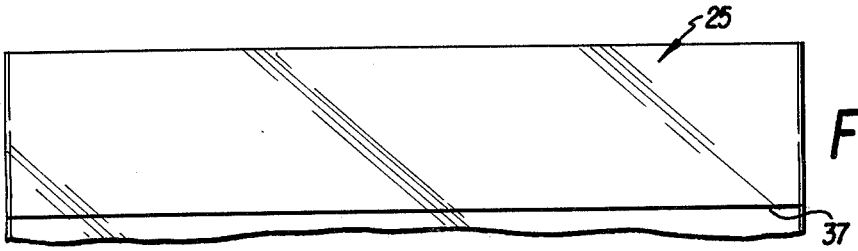
FIG. 5 is a back view of a top portion of the bag of FIG. 1 showing one embodiment of the tuck-in cuff construction.
Figure 6:
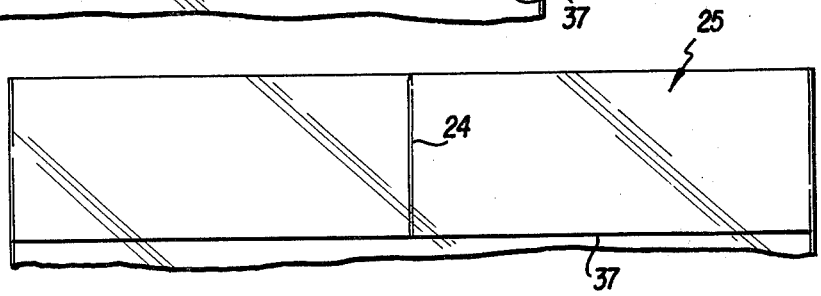
FIG. 6 is a view similar to FIG. 5, but showing a second embodiment of the tuck-in cuff.
Figure 7:
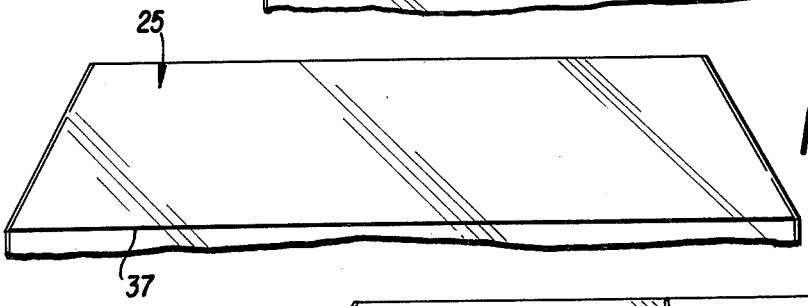
FIG. 7 is a view similar to that of FIG. 5, but showing a third embodiment of the tuck-in cuff.
Figure 8:
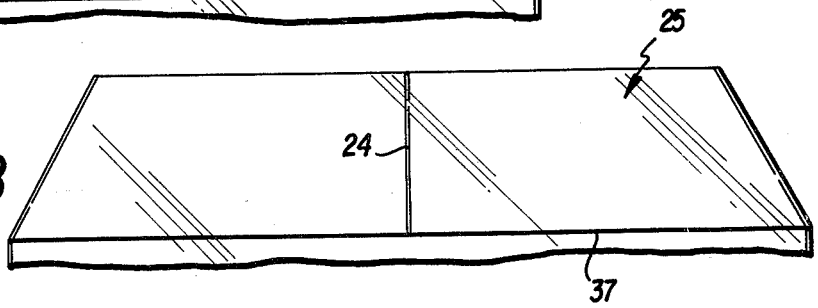
FIG. 8 is a view similar to that of FIG. 5, but showing a fourth embodiment of the tuck-in cuff.
Figure 9:
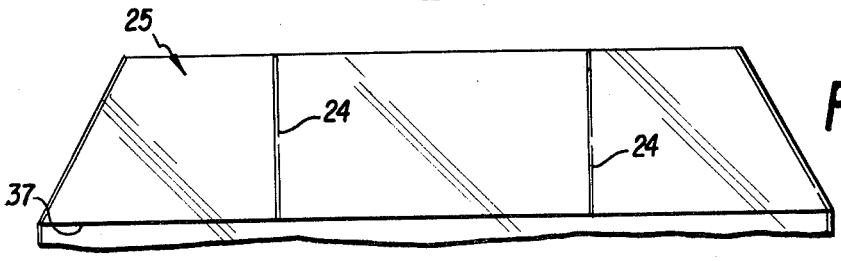
FIG. 9 is a view similar to that of FIG. 5, but showing a fifth embodiment of the tuck-in cuff.

The tuck-in cuff 25 of the invention may have any one of several different constructions. FIG. 5 illustrates a tuck-in cuff having seals only at the side edges thereof forming a single pocket for finger insertion. The side edges of the tuck-in cuff also extend straight along the side edges of the bag. FIG. 6 illustrates a modification of the tuck-in cuff of FIG. 5 wherein a vertical seal 24 is formed interconnecting the back wall 15 and second cuff wall 19 to thus form two pockets in the cuff. FIG. 7 illustrates a modification of the FIG. 5 tuck-in cuff wherein the cuff side walls are tapered inwardly. FIG. 8 illustrates a modification of the FIG. 7 tuck-in cuff wherein a vertical seal, similar to that illustrated in FIG. 6, is provided. Finally, FIG. 9 illustrates a tuck-in cuff construction in which two vertical seals are provided on the cuff illustrated in FIG. 7 to thus form three pockets in the cuff for finger insertion.

As described, the bag of the invention is particularly suitable for use as a sandwich bag, although other uses are also envisioned. The bag can be made out of any suitable plastic, preferably a transparent plastic such as polyethylene or the like.

Although several different embodiments of the invention have been illustrated, it should be clear that other modifications can be made without departing from the spirit and scope of the invention. Accordingly, the invention is not to be construed as limited by the foregoing description but only by the claims attached thereto.

What is claimed is:

1. A plastic bag comprising front and back walls interconnected to one another at their side and bottom edges and defining between them a top opening, a fold-over cuff provided adjacent said top opening for folding over and closing said top opening, said fold-over cuff being formed by a first cuff wall extending along a top portion of said front wall and attached to said front wall at the side and top edges thereof to form a bottom opening between said cuff wall and said front wall at a front side of said bag, and, in tuck-in cuff extending from said back wall in a manner which allows it to be tucked in over an object placed in said bag prior to the closing of said top opening by said fold-over cuff, said tuck-in cuff being formed by a second cuff wall extending along a portion of said back wall which extends beyond said top opening, said second cuff wall being attached at the top and side edges thereof and along at least one vertical line intermediate its side edges to said back wall portion to form a plurality of bottom opening pockets between said back wall and second cuff wall on the back side of said bag.

2. A bag as in claim 1 wherein said second cuff wall is an extension of said back wall which is folded over and attached along its edges to the edges of said back-wall.

3. A bag as in claim 1 wherein the side edges of said tuck-in cuff extend straight along the side edges of said bag.

4. A bag as in claim 1 wherein the side edges of said tuck-in cuff taper inwardly.

* * * * *

UNITED STATES PATENT AND TRADEMARK OFFICE

CERTIFICATE OF CORRECTION

PATENT NO. : 4,332,347

DATED : June 1, 1982

INVENTOR(S) : William J. Clayton

It is certified that error appears in the above—identified patent and that said Letters Patent is hereby corrected as shown below:

Column 4, Line 1, (Claim 1 (amended)), "in tuck-in cuff" should read -- a tuck-in cuff --.

Signed and Sealed this

*Tenth* Day of *August 1982*

[SEAL]

*Attest:*

GERALD J. MOSSINGHOFF

*Attesting Officer*

*Commissioner of Patents and Trademarks*